US005671826A

United States Patent [19]

Zenoni

[11] Patent Number: 5,671,826

[45] Date of Patent: Sep. 30, 1997

[54] WEFT THREAD LUBRICATION DEVICE FOR WEAVING LOOMS

[75] Inventor: Pietro Zenoni, Leffe, Italy

[73] Assignee: L.G.L. Electronics S.p.A., Bergamo, Italy

[21] Appl. No.: 563,035

[22] Filed: Nov. 27, 1995

[30] Foreign Application Priority Data

Dec. 2, 1994 [IT] Italy ..... TO94A0984

[51] Int. Cl.[6] ..... F16N 7/12

[52] U.S. Cl. ..... 184/16; 184/15.1; 184/64; 184/102; 118/234

[58] Field of Search ..... 184/15.1, 16, 102, 184/64; 118/234

[56] References Cited

U.S. PATENT DOCUMENTS

| | | | |
|---|---|---|---|
| 1,662,086 | 3/1928 | Stuhr | 184/64 |
| 1,670,696 | 5/1928 | Stuhr | 184/64 |
| 1,684,923 | 9/1928 | Mayer | 118/234 |
| 2,022,854 | 12/1935 | Greenwood . | |
| 2,084,960 | 6/1937 | Johnson et al. | 118/234 |
| 2,201,803 | 5/1940 | Todd | 184/15.1 |
| 2,317,874 | 4/1943 | Almy . | |
| 2,781,021 | 2/1957 | Schmitz . | |
| 4,573,314 | 3/1986 | Lorenz | 118/234 |
| 5,520,732 | 5/1996 | Sarfati | 118/234 |

FOREIGN PATENT DOCUMENTS

| | | | |
|---|---|---|---|
| 340746 | 11/1989 | European Pat. Off. . | |
| 1222830 | 1/1959 | Germany . | |
| 3808939 | 10/1988 | Germany . | |
| 4311619 | 10/1994 | Germany . | |
| 604483 | 5/1960 | Italy | 184/16 |

*Primary Examiner*—Thomas E. Denion
*Attorney, Agent, or Firm*—Guido Modiano; Albert Josif; Daniel O'Byrne

[57] ABSTRACT

The device comprises a container, closed by a lid, for holding the lubricating fluid; a strip of felt or the like is immersed in the container and becomes impregnated with the fluid by capillary action. One end of the strip protrudes from the lid of the container and wraps around a cylindrical support so that a respective portion of the strip, shaped like a cylindrical sector and impregnated with lubricating fluid, protrudes with respect to the surface of the lid and is exposed. The weft thread to be lubricated is made to slide on the exposed portion of the strip, and means are provided for guiding the thread and for producing a cyclic transverse movement thereof from one end to the other of the exposed portion.

5 Claims, 2 Drawing Sheets

WEFT THREAD LUBRICATION DEVICE FOR WEAVING LOOMS

BACKGROUND OF THE INVENTION

The present invention relates to a device for lubricating the weft thread for weaving looms.

It is known that in high-speed weaving processes performed with modern shuttle-less air jet looms, projectile looms, and the like, the weft thread is unwound from the spool by a weft pre-feeder interposed between the spool and the loom which accumulates a reserve of thread in the form of turns that unwind from the feeder when requested by the loom.

In many cases, in order to achieve perfect insertion of the weft between the warp threads, it is necessary, due to the high beating rates of the loom, to lubricate the weft thread to eliminate, or at least reduce, the sliding friction of said weft on the warp threads. Weft lubrication also allows to obtain a thread that is more uniform and consequently can be better processed, is less subject to jamming and therefore to breakage, and can be handled more easily by the pre-feeder too, since lubrication generally facilitates sliding and attenuates sudden variations in the sliding speed caused by localized friction variations. Normally, the thread is lubricated when it is taken from the spool to be woven immediately, with vegetable low-viscosity oils or mixtures of oils, and the treatment must be performed in such a manner to ensure uniform lubrication despite the thread unwinding speed, avoiding both excessive and insufficient impregnation.

SUMMARY OF THE INVENTION

The principal aim of the present invention is to provide a lubrication device that can provide, industrially and without using labor, the lubrication of the weft thread when taken from the spool with the above-mentioned uniform treatment methods, regardless of the unwinding speed of said thread and of any stops thereof.

Another object of the invention is to provide a lubrication device having an extremely simplified structure, being highly reliable in operation, and economically advantageous.

A further object of the invention is to provide a lubrication device requiring an occasional monitoring substantially aimed at merely restoring the level of the lubricating fluid.

According to the present invention, this aim, these important objects, and others which will better appear hereinafter are achieved with a weft thread lubrication device having the specific features given in the appended claims.

Substantially, the device according to the invention is constituted by a container for holding the lubricating fluid, in which a strip of spongy material, such as felt or the like, is immersed; by capillary action, said strip becomes impregnated with said fluid. This strip, having an adequate width, for example between 100 and 150 millimeters, wraps around a nonrotating supporting roller having a cylindrical sector which protrudes with respect to the surface of a lid of the container, so that a respective portion of said strip, shaped like a cylindrical sector and impregnated with lubricant, correspondingly protrudes with respect to the surface of said lid and is exposed.

The weft thread to be lubricated is made to slide on the cylindrical-sector portion, or exposed portion, of the strip of felt or the like; a guiding bush, which can move transversely to the thread sliding direction with a reciprocating motion imparted by a motorized screw, moves said thread in a cyclic manner from one side of the exposed portion to the other side of the exposed portion of said strip portion, so as to utilize its entire impregnated surface. The supporting roller is subjected to manual angular movements imparted by means of an external knob and having the purpose of replacing the exposed surface of the felt strip when it shows signs of wear.

According to a further embodiment of the invention, which is aimed at simplifying the device by avoiding its motorization, the cyclic motion for shifting the thread from one end to the other of the exposed portion of the impregnated strip is produced by the so-called "balloon" that the thread forms by unwinding from the spool; in this case the guiding bush is eliminated and replaced with a simple thread guiding slot.

BRIEF DESCRIPTION OF THE DRAWINGS

The characteristics, purposes, and advantages of the device according to the invention will become apparent from the following detailed description and with reference to the accompanying drawings, given by way of non-limitative example, wherein.

DESCRIPTION OF THE PREFERRED EMBODIMENTS

Figure 1:
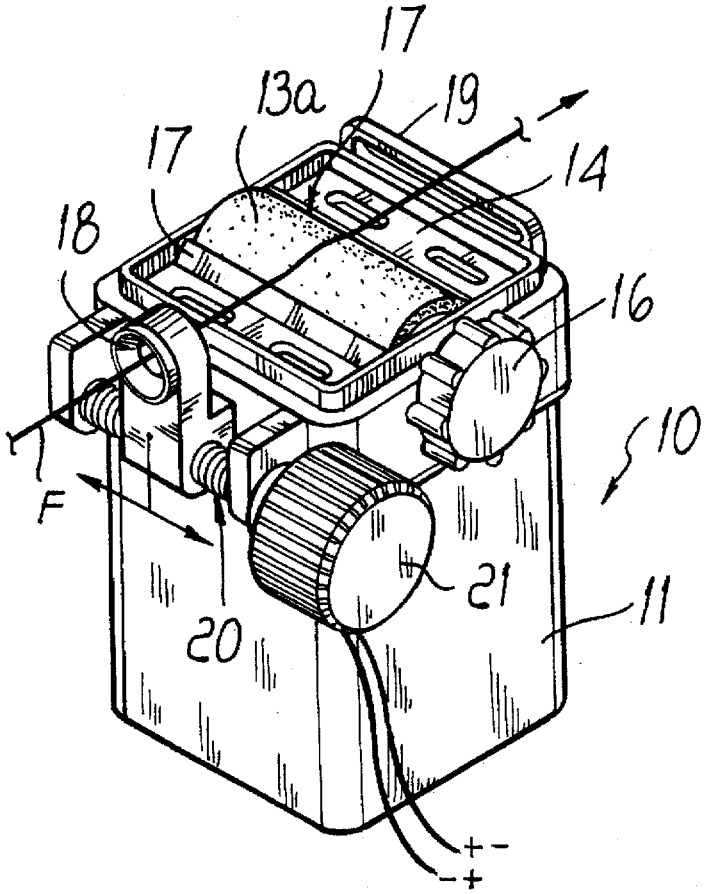
FIG. 1 is a perspective view of the lubrication device according to an embodiment of the invention.
Figure 2:
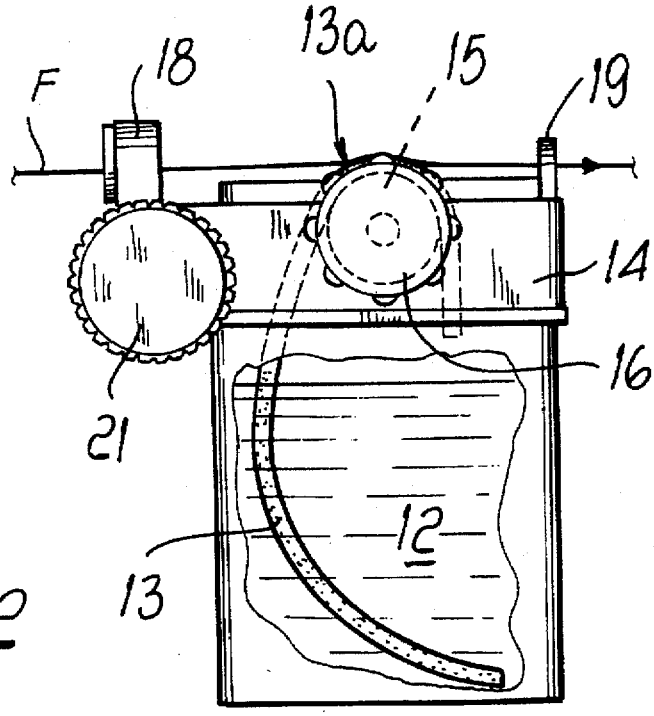
FIG. 2 is a partially sectional side view of the device of FIG. 1.

With reference to FIGS. 1 and 2, the lubrication device 10 comprises a parallelepiped-shaped container 11, for holding the lubricating fluid 12, which constists in a known manner of a vegetable low-viscosity oil or mixture of oils. A strip 13 of felt, or other spongy material capable of absorbtion by capillary action, is immersed in the mass of the lubricating fluid 12 and has a width of for example 150 to 200 millimeters; an exterior end of the strip protrudes beyond a lid 14 of the container 11 to wrap partially around a support 15, which is shaped like a cylindrical roller, is rigidly coupled to said lid, and can perform angular movements, preferably in a stepwise manner, that are imparted manually by virtue of a knob 16.

The roller 15 has a cylindrical portion protruding from an opening of the lid 14 beyond the surface of said lid, so that a respective cylindrical portion **13*a* of the strip 13, impregnated with lubricant, correspondingly protrudes beyond said lid and is exposed. Two lips 17, preferably made of elastomeric material, cover the gaps between the strip 13 and the lid 14 to prevent the entry of dust, lint, and the like in the container 11. The thread F, that unwinds directly from the spool, is made to slide, with a slight contact pressure, on the exposed portion 13*a* of the strip of felt 13. A bush 18, movable in a reciprocating manner, guides the entry of the thread in the device and moves said thread in a cyclic manner transversely to its sliding direction from one side to the other side of the exposed portion 13*a* of the felt strip 13, so as to utilize the entire impregnated surface of said strip; a thread guiding slot 19** is arranged at the exit of the device.

For this purpose, the bush 18 is provided with a fixed female thread in which a correspondingly threaded screw 20 engages; said screw is turned by a reversible electric motor 21 controlled by limit switches (not shown) that are sensitive for example to electrical input. The rotation of the supporting roller 15 allows to periodically change the exposed surface 13*a* of the felt strip when it shows signs of wear.

Figure 3:
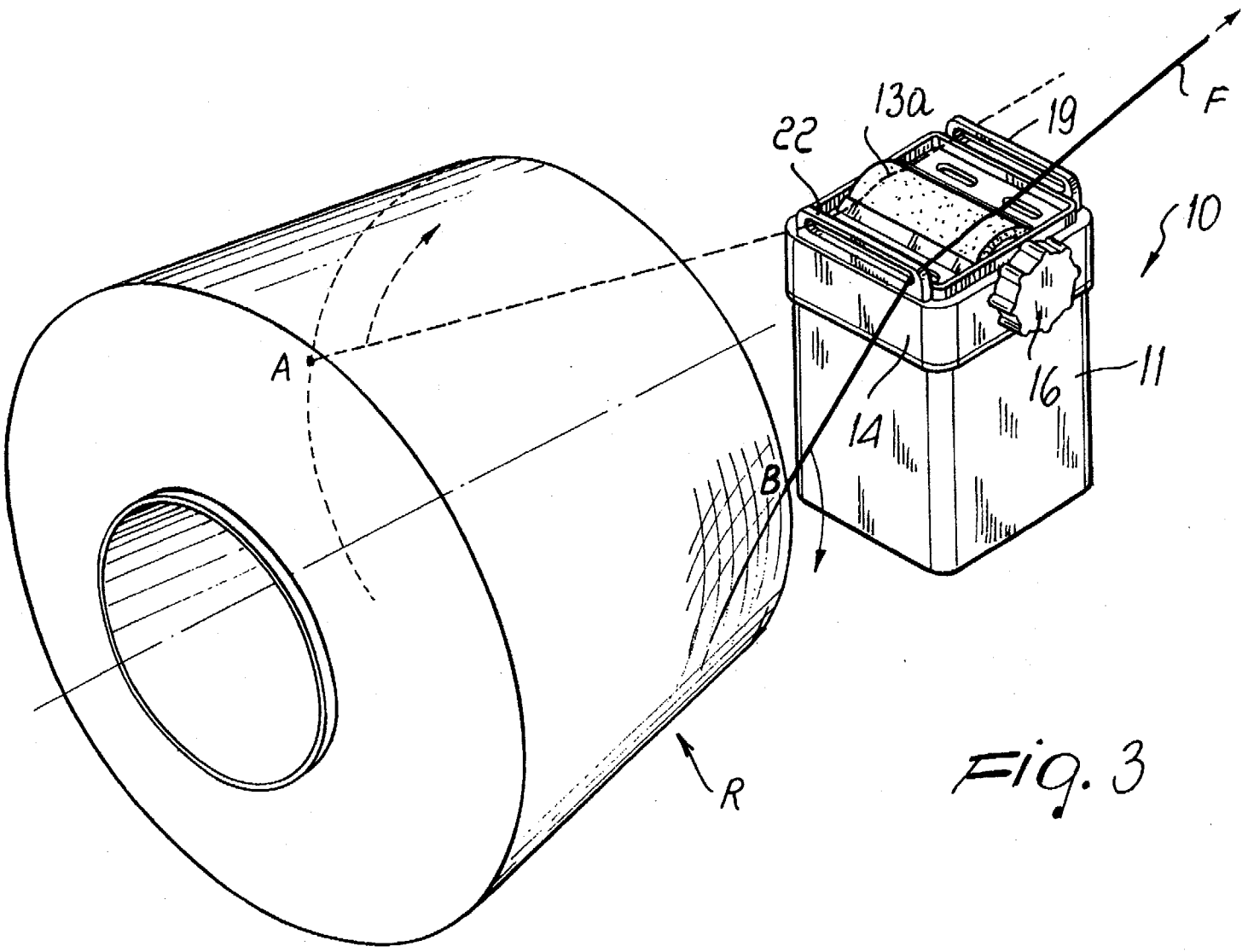
FIG. 3 is a perspective view, similar to FIG. 1, showing a different embodiment of the device according to the invention.

The embodiment of FIG. 3, in which similar or corresponding parts are designated by the same reference numeral, differs in that the bush 18, with the corresponding kinematic system and actuation motor 20 and 21, are omitted in favour of greater simplification. In this case, the cyclic transverse motion of the thread is produced by the so-called thread "balloon", that is to say, by the rotation which, when unwinding, said thread performs about the spool R, passing in a cyclic manner in diametrically opposite points, such as A and B, and moving from one side to the other of said spool.

A second thread guiding slot 22 is also provided at the inlet of the device 10 in replacement of the bush 18, in order to control the transverse movement of the thread and keep it in contact with the portion 13*a* of the strip 13.

Without altering the concept of the invention, the details of execution and the embodiments may of course vary extensively with respect to what has been described and illustrated by way of non-limitative example without thereby abandoning the scope of the invention that is defined by the appended claims.

What is claimed is:

1. A device for lubricating weft thread for weaving looms, comprising: a container for holding lubricating fluid; a lid for closing said container; a strip of absorbing material being immersed in said container and being impregnated with said fluid by capillary action; a cylindrical support; an exterior end of the strip protruding from the lid of the container and wrapping around said support so that a respective portion of the strip, shaped as a cylindrical sector and impregnated with lubricating fluid, protrudes with respect to an upper surface of the lid for being exposed; the weft thread to be lubricated being made to slide on said exposed portion of the strip; and guiding means for guiding the thread and for producing a cyclic transverse movement thereof from one side of said exterior end to the other side of said exterior end of said exposed portion of the strip.

2. A device according to claim 1, wherein said guiding means comprises a thread guiding bush which is actuated with a reciprocating transverse motion, said bush being arranged at a thread inlet of the device, and a thread guiding slot arranged at a thread outlet of said device.

3. A device according to claim 2, wherein the thread guiding bush is provided with a female thread being engaged by a screw, said screw being turned in opposite directions by a reversible electric motor, said motor being controlled by limit switches.

4. A device according to claim 1, wherein said cylindrical support of the strip of absorbing material is constituted by a roller, said roller being rotatably coupled to said lid of the container for performing angular movements, a knob being further provided for manually imparting said angular movements to said roller for replacing the exposed portion of the strip when said portion is worn.

5. A device according to claim 1, wherein said guiding means comprises a thread guiding slot being located at a thread inlet of the device, said guiding slot maintaining said thread in contact with said exposed portion of the strip, and the cyclic transverse motion of the thread on said exposed portion being produced by unwinding rotation of said thread about a thread spool.

* * * * *